United States Patent [19]

Smith

[11] 4,326,344

[45] Apr. 27, 1982

[54] LAUNDRY DRYING SYSTEM AND METHOD

[75] Inventor: David G. Smith, Fort Wayne, Ind.

[73] Assignee: Q-dot Corporation, Dallas, Tex.

[21] Appl. No.: 739,816

[22] Filed: Nov. 8, 1976

[51] Int. Cl.[3] ..... F26B 11/04

[52] U.S. Cl. ..... 34/54; 34/86; 34/133; 165/DIG. 2; 165/104.26

[58] Field of Search ..... 34/86, 35, 133, 54; 165/DIG. 2, 105; 432/223; 165/133, 179; 138/38

[56] References Cited

U.S. PATENT DOCUMENTS

| | | | |
|---|---|---|---|
| 3,753,364 | 8/1973 | Runyan et al. | 165/105 |
| 3,865,184 | 2/1975 | Grover | 165/105 |
| 4,028,817 | 6/1977 | Winstel | 34/86 |
| 4,058,159 | 11/1977 | Iriarte | 165/105 |

FOREIGN PATENT DOCUMENTS 573093 2/1976 Switzerland .

OTHER PUBLICATIONS

McGraw-Hill Encyclopedia of Science and Technology, vol. 6, (GAB-HYS), 1971, p. 417.

*Primary Examiner*—Larry I. Schwartz

*Attorney, Agent, or Firm*—Hubbard, Thurman, Turner, Tucker & Glaser

[57] ABSTRACT

A laundry drying system and method in which fresh air flows through a low temperature duct of a preheater, then through a primary heater before entering a laundry drying chamber is described. The air enters into contact with laundry in the chamber, then is exhausted, flowing through a high temperature duct of the preheater. In the preheater, heat pipes transfer heat from the exhaust air in the high temperature duct to the fresh air in the low temperature duct. Thus, heat which would otherwise be discarded in the exhaust air stream is recovered for use in the drying process. The preheater preferably uses heat pipes having a liquid return tube and set in a plate fin heat exchanger. To provide for a cool down cycle, there is a bypass which defeats the operation of the preheater. Lint exhausted by the drying chamber is partly collected by a dry type lint remover between the chamber exhaust and the preheater. Lint not thus collected can accumulate on the edges of the heat exchanger fins, which are closely spaced for this purpose, rather than accumulate on the heat pipes. Provision is made to open the system for removal of the accumulated lint and to pull out the preheater for cleaning off substances condensed in its high temperature duct.

2 Claims, 4 Drawing Figures

LAUNDRY DRYING SYSTEM AND METHOD

This invention relates to a laundry drying system and method. In a laundry drying system, laundry in a drying chamber is subjected to a flow of heated, dry air. When the air leaves the chamber, it is still relatively hot compared to fresh air, and contains moisture absorbed from the laundry. It would be desirable if heat energy in this chamber exhaust air could be used in the drying process rather than simply discarded in the exhaust of the system.

One approach to utilizing the exhaust air heat has been to recirculate a portion of the exhaust into the drying chamber, mixed with fresh, heated makeup air. The shortcoming of this approach is that it also carries some moisture from the laundry back into the chamber.

Another approach employs a heat exchanger to transfer heat from the exhaust air stream to that air which is flowing to the drying chamber. This approach is used, for example, in U.S. Pat. No. 3,859,735 to Katterjohn, Jr. In that patent, an indirect heat exchanger is used as a preheater of the fresh air before it reaches the primary heating source of the dryer. The result being sought in such an approach is to recover heat from the exhaust air, without introducing moisture from the exhaust into the fresh air stream, as happens with the recirculation approach.

The present invention makes use of the superior heat exchange capabilities of heat pipes. A heat pipe comprises a sealed envelope containing a working fluid having both a liquid phase and a vapor phase in the desired range of operating temperatures. When one portion of the envelope is exposed to a relatively higher temperature, it functions as an evaporator section. The working fluid is vaporized in the evaporator section and flows in the vapor phase to the relatively lower temperature section of the envelope which becomes a condenser section. The working fluid is condensed in the condenser section and then returns in the liquid phase in a short time from the higher temperature section of the envelope to the lower temperature section as a consequence of the phase change of the working fluid. In a heat exchange application, heat is transferred to the heat pipe at the evaporator section, vaporizing the working fluid; then heat is given off by the heat pipe at the condenser section, when the vapor condenses.

SUMMARY OF THE INVENTION

In the system according to the present invention, fresh air flows through the low temperature duct of a preheater, then through a primary heating source, before entering a drying chamber. Air exhausted from the drying chamber flows through a high temperature duct of the preheater. Heat pipes in the preheater transfer heat from the chamber exhaust air in the high temperature duct to the fresh air in the low temperature duct.

In a preferred embodiment, the preheater employs a particularly effective type of heat pipe having a separate liquid phase return tube within the outside envelope of the pipe and having a separate liquid phase return tube within the outside envelope of the pipe and having capillary grooves around the interior periphery of the envelope.

In order that the system can provide a high level of performance using heat pipes, preferred embodiments of the invention have features which deal with the presence of lint in the air exhausted from the drying chamber. Lint could accumulate in the elements of the preheater, lowering heat transfer capabilities and/or impeding air flow. In one embodiment, lint is partly collected by suitable filtering means between the chamber exhaust and the preheater. The filtering means is preferably a dry type lint remover. The heat pipes can be set in fins to increase heat exchange. In a preferred configuration, the heat pipes are in a plate fin heat exchanger, that is, one with a plurality of fins, each fin contacting all of the heat pipes. The fins are preferably planar and sufficiently closely spaced to catch lint on the edges of the fins, rather than on the heat pipes. The lint can collect in a matted surface on the edges of the fins at the inlet of the preheater, from which it can be periodically cleaned.

In one embodiment, the system of the invention provides for a cool down cycle in which the heater is shut off and unheated air flows through the drying chamber to cool the laundry for removal. During this period, the heating of the fresh air by the preheater is interrupted. In a preferred embodiment, a bypass opens at the onset of the cool down period to route the flow of air away from one of the ducts of the preheater.

Also in accordance with the invention, means are provided to move the preheater away from other elements of the system. There are substances found in laundry, such as oil in rags, which can be vaporized and carried out by the exhaust air. Some of these substances can condense and build up in the heat exchange elements of the preheater. If the preheater can be conveniently disengaged, then a solvent can be applied to remove the condensed substances.

In accordance with the invention, there is also provided a method of drying laundry which includes the basic steps of generating a stream of air entering into contact with the laundry, and a stream of air exhausted therefrom, while applying heat to the entering stream of air. The method further includes enclosing a working fluid separate from the streams of air, while placing the fluid in heat exchanging relationship with the exhausted stream of air to evaporate the fluid. Further, the evaporated working fluid is directed into heat exchanging relationship with the entering stream of air, upstream from the application of heat, to condense the evaporated working fluid. As a result, heat is transferred from the exhausted stream to the working fluid and from the working fluid to the entering stream of air.

The present invention provides a laundry system and drying method of a quality suitable for commercial installations. Among the features set forth above are those which make practical the implementation of a heat recovery approach in such an environment, such as the provision for rapid cool down and the means for disengaging the preheater for cleaning of condensed matter. Others of the features support the use of a particular preheater. They are therefore influential on the extent to which preheating saves energy which would otherwise have to be provided by the primary heating source. The system and method of the invention have considerable economic feasibility in this respect, being capable of saving twenty to thirty percent on fuel consumption.

The effectiveness of the heat recovery has been achieved largely by making feasible the use of heat pipes. Because they operate on a principle of phase change, rather than conduction or convection, heat pipes are capable of transferring heat at a much higher rate than an indirect heat exchanger, such as that in the Katterjohn, Jr. patent. Thus, it is important that the present invention provides a combination which enables heat pipes, rather than an indirect heat exchanger, to be used in such a laundry system.

The nature of the invention, its features and advantages, as set forth above, may be understood more fully upon the consideration of particular embodiments. The following is a description of some preferred embodiments and how to make and use them. It is to be read in conjunction with the accompanying drawings, wherein.

Figure 1:
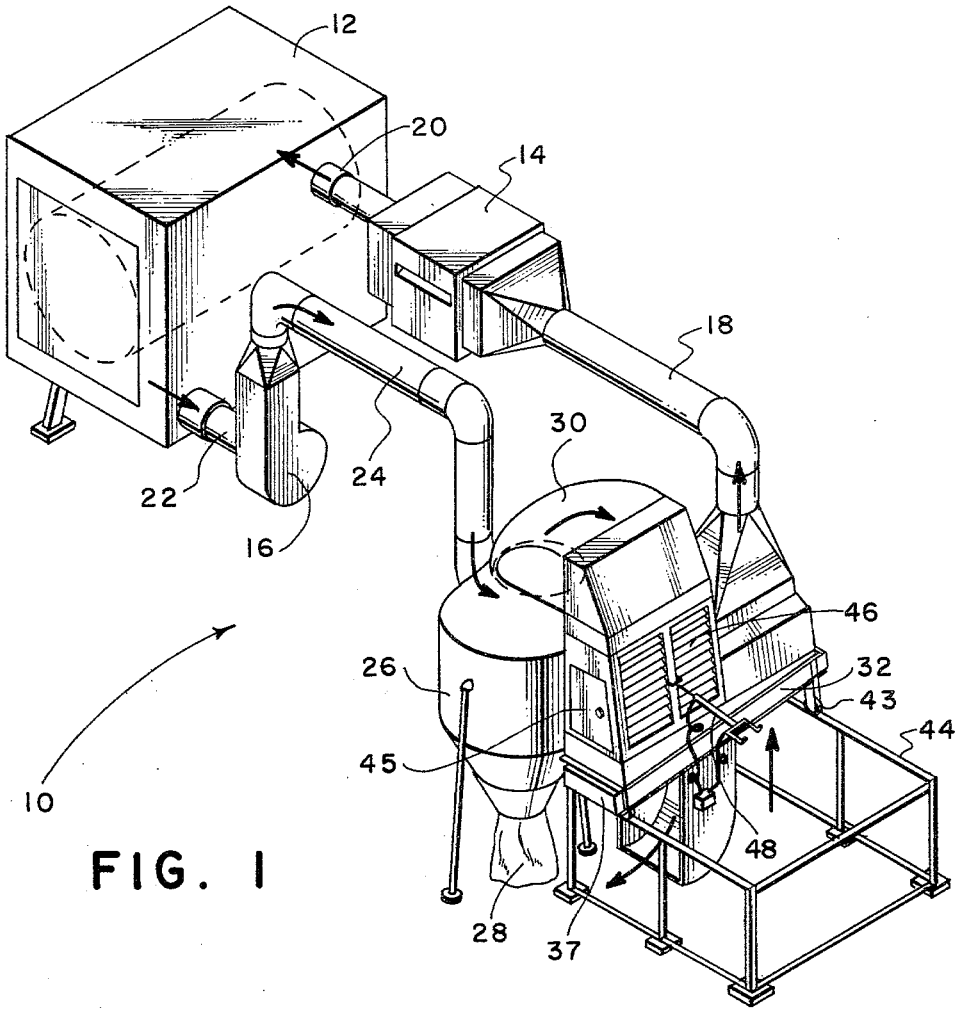
FIG. 1 is a perspective view of a drying system according to the invention.

FIG. 1 shows a laundry drying system according to the invention, indicated generally by the reference numeral 10. Drying chamber 12 is, for example, a conventional tumble dryer, wherein the laundry is to be subjected to a flow of hot, dry air. The primary heating source for the air is heater 14, for example, a gas fired heater. The air flow is provided by blower 16. It draws air into an inlet 18 of heater 14, from which the heated air is directed into an inlet 20 of the drying chamber 12. The heated air passes through the drying chamber, evaporating some moisture from laundry therein. The air is exhausted from the chamber at outlet 22, which is connected to the inlet of blower 16. Preferably, the air from the outlet 24 of blower 16 passes, as shown in FIG. 1, into a lint remover 26, which collects lint from the air in bag 28 and exhausts the air at outlet 30.

Outlet 30 of lint remover 26 is connected to the high temperature side of a preheater 32. After air from outlet 30 passes through the preheater, it is exhausted from the system 10, usually at a lower temperature than when it entered the preheater. The fresh air for the system 10 passes through the low temperature side of preheater 32, which is connected to direct the air to inlet 18 of heater 14.

Figure 2:
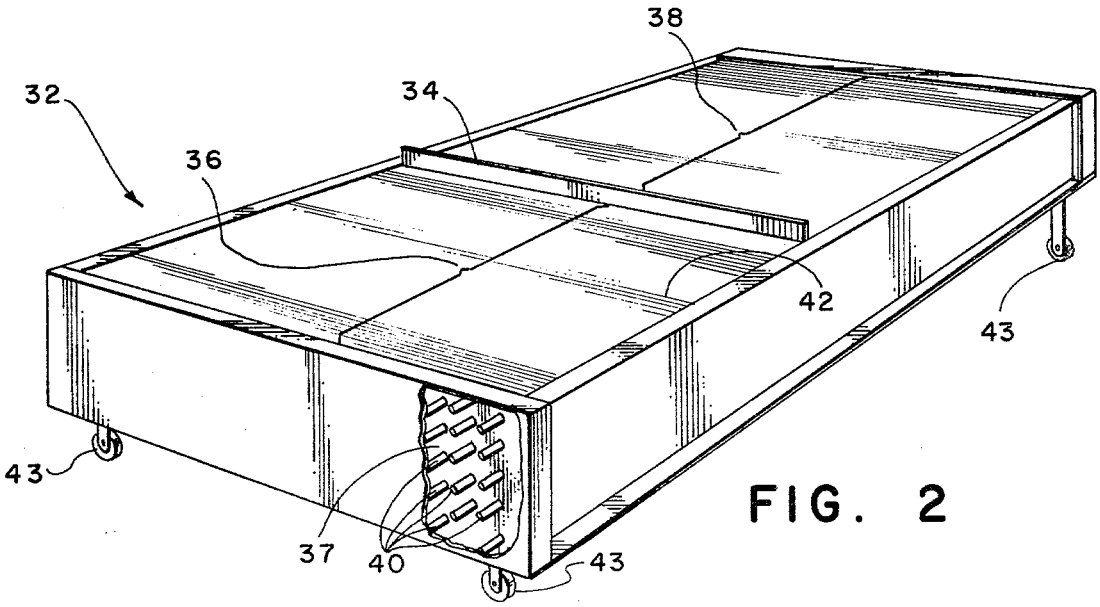
FIG. 2 is a perspective view of the preheater.

Shown in greater detail, in FIG. 2, preheater 32 is divided by a partition 34 into exhaust duct 36 for air at a relatively higher temperature and inlet duct 38 for air at a relatively lower temperature. Partition 34 serves to isolate air flowing through inlet duct 38 from air flowing through exhaust duct 36. Heat pipes 40 extend from exhaust duct 36 through partition 34 into inlet duct 38. Duct 36 is normally connected to lint remover 26 outlet 30, while duct 38 conveys fresh air to the inlet 18 of heater 14.

In a preferred embodiment, the heat pipes 40 can have fins 42 for increasing heat exchange efficiencies with air flowing through ducts 36 and 38. Normally, each fin is approximately the width and depth of the preheater 32 and contacts all the pipes 40, forming a plate fin heat exchanger.

Figure 3:
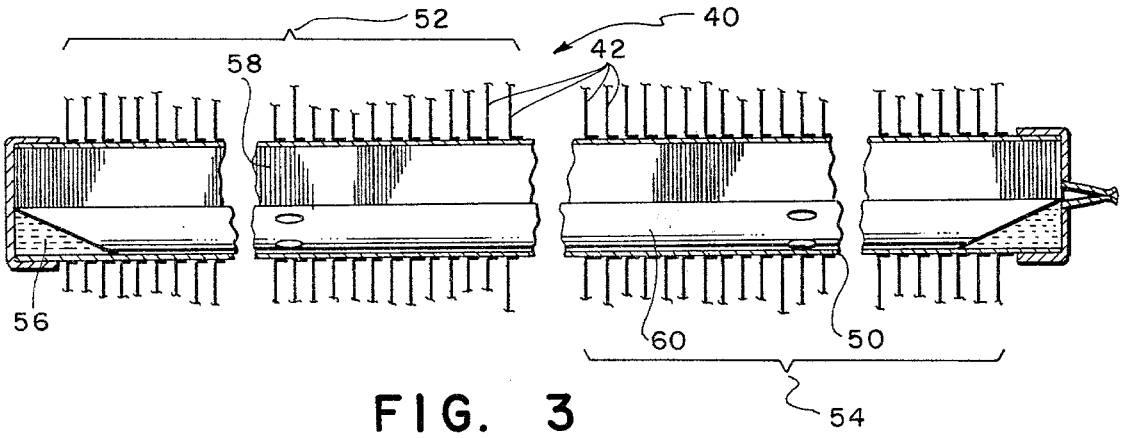
FIG. 3 is a longitudinal sectional view of a heat pipe in the preheater.

The heat pipes 40 are preferably of the type having a liquid return tube. The structure of such a heat pipe and its advantages are described in Swiss Pat. No. 573,093. Major features of the pipe are shown in FIG. 3. Each such preferred heat pipe has an elongated, closed, tubular envelope 50 formed from a thermally conductive material, and defines an evaporator section 52 in inlet duct 38. There is a liquid phase/vapor phase working fluid 56, such as Freon, in the envelope 50 that is vaporized in the evaporator section 52 by heat from the air in exhaust duct 36. The working fluid 56 flows, in the vapor phase, into the condenser section 54, where it condenses, transferring heat of condensation to the air in inlet duct 38. The fluid then flows, in the liquid phase, back to the evaporator section 52. In the preferred heat pipe, this flow is through a separate liquid phase return tube 60 extending axially in the envelope 50 from the condenser section 54 to the evaporator section 52. The tube 60 promotes a smooth flow of liquid returning to the evaporator section 52.

In order to increase the heat transfer effectiveness of the heat pipes, the interior of the heat pipe envelope 50 can have a series of axially spaced capillary grooves 58 extending around substantially the entire interior periphery of the envelope. The capillary grooves will transport the liquid working fluid above the portion of the working fluid standing in the lower portion of the heat pipe, thereby increasing the surface area or interface between the liquid and vapor.

Referring to FIG. 1, there can be seen a preferred configuration in which preheater 32 is tilted toward the evaporator end 37. The tilt, which can be, for example, a ten percent slope, assists the return of the liquid working fluid, thereby increasing the heat transfer capacity of the heat pipes 40.

In the side of the duct from outlet 30 to exhaust duct 36 there is preferably a door 45, which gives access to the top surface of preheater 32, as for cleaning. In addition, preheater 32 can be mounted on wheels 43 which roll on a frame 44. The preheater can thereby be rolled completely clear of the duct work which connects it with the remainder of the system to aid in the cleaning and maintenance of the preheater.

A further feature which can be included in the air path leading from outlet 30 to preheater exhaust duct 36 is a bypass damper 46 actuated by a control 48. When bypass damper 46 is open, at least a portion of the air is exhausted from the drying system before reaching duct 36.

Figure 4:
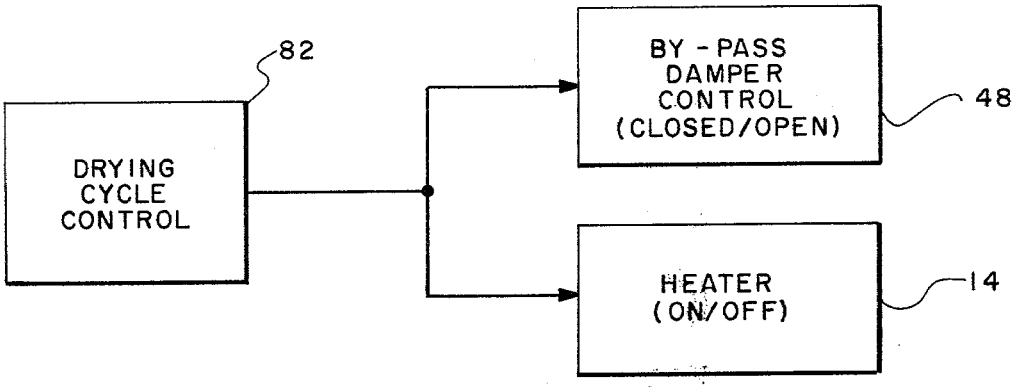
FIG. 4 is a block diagram of the system controlling the heater and bypass damper.

FIG. 4 illustrates the activation of heater 14 and damper 46, when the system 10 is automatically or manually controlled by a drying cycle control 82. When control 82 signals heater 14 to turn on, it also signals damper control 48 to close bypass damper 46. When heater 14 turns off, damper 46 is opened.

In the operation of drying system 10, fresh air is drawn into inlet duct 38 of the preheater and then into inlet 18 of heater 14. If bypass damper 46 is closed, then air leaving lint remover 26 enters exhaust duct 36 of the preheater 32 and upon leaving duct 36 is exhausted from the drying system 10.

The fresh air supply is typically outside air; for example, its temperature might be 65° F. The temperature of the air coming from outlet 30 of lint remover 26 may be at 225° F. The function of preheater 32 is to transfer as much heat as possible from the 225° air entering exhaust duct 36 to the 65° air flowing through inlet duct 38, thereby decreasing the amount of heat which must be provided by heater 14 in order to provide the drying chamber 12 with air of a selected temperature. Heat is transferred from exhaust air in duct 36 to the envelope 50 of each heat pipe 40 by the fins 42. The heating of envelope 50 evaporates the working fluid 56 therein, and by the chain of events described above, heat is transferred from the fluid to the condenser end of envelope 50, in inlet duct 38. The fins in duct 38 transfer the heat to the entering air flowing there.

In the exhaust from a laundry dryer such as chamber 12, there can be a significant amount of lint and other particulate material. Preferably, such materials are not allowed to accumulate in an uncontrolled way on the heat exchange surfaces of preheater 32, because it will tend to insulate the surfaces and impede air flow through the preheater. Accordingly, several features of the system 10 bear on controlling the lint and particulate accumulation.

The bulk of the lint and other particulate material is dealt with by passing the exhaust air of chamber 12 through a filter means such as lint remover 26, before the air enters preheater 32. The lint remover preferably is the dry type. In a wet type filter means, heat energy is removed from the air stream by evaporative cooling and thereby rendered unavailable for heat exchange through the preheater. Moreover, the use of the wet type filter can result in excessive moisture in the heat exchange fins 42.

In dealing with the lint which escapes the remover 26, an important variable is the spacing of fins 42. One approach would be to use wide spacing, so that much of the lint would pass on through the fins. One disadvantage of this is that lint can accumulate on the heat pipes 40 and become quite difficult to remove. Instead, a narrow spacing of the fins has been used, with the goal of catching the lint on the fins at the top of exhaust duct 36. A spacing of 14 fins per inch along a heat pipe is considered satisfactory in this regard. The lint which is too small to be caught by the fins is generally small enough to avoid accumulating on the heat pipes. The lint which does accumulate on the top of fins 42 forms a mat, which may be readily vacuumed off, for example, daily, with access through door 45.

The use of the preferred plate fin heat exchanger, that is, where each large fin contacts all the heat pipes, is advantageous to the control of lint accumulation. In an alternate design, each heat pipe would have its own small circular fins. In the latter case, lint could collect on the edges of the fins, but the fins of pipes on the interior of the heat pipe cluster would be relatively inaccessible for cleaning. With the plate fin heat exchanger, it is preferable to use plain fins, that is, completely planar ones, rather than corrugated fins. The corrugated fins provide better heat exchange, but have a greater tendency to trap lint inside the preheater rather than on top. If there is no particular problem of lint or particulate material in the exhaust stream, corrugated fins are preferred.

In the system 10, provision has been made to roll out preheater 32, so that it may be cleaned with detergent, solvent or steam. The need for this can arise, for example, when the laundry in chamber 12 contains oil or grease which is vaporized by the drying heat. Some of the vaporized material may condense in the preheater 32, producing a gradual buildup that must be removed from time to time.

When laundry has finished drying in chamber 12, it may be desirable to shut off heater 14, while continuing to operate blower 16, so that unheated air will flow through chamber 12 cooling the laundry for handling and removal. It is at the onset of this cool-down cycle that damper control 48 is signalled to open bypass damper 46 so as to bypass duct 36 of the preheater 32. This immediately interrupts the transfer of heat from the exhaust air to the air entering drying chamber 12 and allows the entering air to become cool.

An alternate embodiment of the bypass would be a damper in inlet 18 that covers a fresh air opening during the drying cycle. For the cooldown 18 cycle, it would turn to uncover the fresh air opening into inlet 18 and block the duct from preheater 32 to inlet 18. At that point, the air into heater 14 would not be preheated, but the exhaust of the system 10 would still pass through the high temperature duct 36 of the preheater 32. For a brief period at the beginning of the cool-down cycle, the air into duct 36 would be hot, but there would be no air flow through the preheater flow temperature duct 38. This would raise the temperature of the fins 42 and heat pipes 40 in duct 36 to a temperature higher than that occurring during the drying cycle, thereby vaporizing oils or other materials which have condensed there. In yet another embodiment, the means for interrupting preheating is a means for tilting the bent pipes toward their condenser ends, thus decreasing their heat transfer capacity.

It is preferable to have the exhaust from duct 36 be downward, as shown in FIG. 1, because a considerable amount of moisture may condense on the heat pipes 40 in duct 36. Because the air in preheater 32 becomes cooler as it nears the outlet of the preheater, condensation is heaviest on the heat pipes nearer the outlet. When the exhaust is downward, this heaviest condensation is at the bottom and tends to drip out of preheater 32. If the moisture were to collect in the preheater 32, it could offer substantial resistance to air flow.

The moisture condensation can be sufficient to require a drain for it. If preheater 32 is outside in a cold climate, the area where the condensate collects may require a heater to prevent freezing.

Although preferred embodiments of the invention have been described in detail, it is to be understood that changes, substitutions, and alterations can be made therein without departing from the spirit and scope of the invention as defined by the appended claims.

What is claimed is:

1. A laundry drying system, comprising:

a drying chamber;

blower means for generating a flow of air entering the chamber and a flow of air exhausted therefrom;

heater means for heating said entering air during a drying period and ceasing to heat the entering air during a cool-down period;

a preheater, including:

a first duct carrying said flow of entering air before said entering air reaches the heater means;

a second duct carrying said flow of exhausted air, in an approximately downward direction, said ducts being adjacent and joined for movement as a unit;

a plurality of heat pipes, each projecting into both of said ducts, with the end of each pipe in the second duct being lower than the opposite end of the pipe in the first duct; and a plurality of planar fins in each of the ducts, each fin contacting all of the heat pipes, with the fins sufficiently close to one another that lint which may be in said exhausted air can accumulate on the edges of said fins, whereby heat can be transferred to said entering air in the first duct from hotter, exhausted air in the second duct;

means for filtering, by a dry method, lint from said exhausted air before the exhausted air reaches the preheater;

means for moving the preheater away from other elements of the system, for cleaning of the preheater; and means, including a bypass damper, for routing said flow of exhausted air away from said second duct during the cool-down period.

2. A laundry drying system, comprising:

a chamber;

blower means for generating a flow of air entering the chamber and a flow of air exhausted therefrom;

heater means for heating said entering air during a drying period and ceasing to heat the entering air during a cool-down period;

a preheater, including:

a first duct carrying said flow of entering air before said entering air reaches the heater means, a second duct carrying said flow of exhausted air, and a plurality of heat pipes, each projecting into both of said ducts, whereby heat is transferred during said drying period to said entering air in the first duct from hotter, exhausted air in the second duct; and means for interrupting, at the onset of the cool-down period, the transfer of heat from the exhausted air to the entering air, wherein said interrupting means includes bypass means for routing one of said flows away from the preheater.

* * * * *